US006941095B2

(12) United States Patent
Kidaka

(10) Patent No.: US 6,941,095 B2
(45) Date of Patent: Sep. 6, 2005

(54) IMAGE FORMING APPARATUS USING IMAGE CARRIER CLEANERLESS SYSTEM

(75) Inventor: Hiroyuki Kidaka, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/660,584

(22) Filed: Sep. 12, 2003

(65) Prior Publication Data

US 2004/0057750 A1 Mar. 25, 2004

(30) Foreign Application Priority Data

Sep. 20, 2002 (JP) ..... 2002-276136

(51) Int. Cl.[7] ..... G03G 15/30
(52) U.S. Cl. ..... 399/149; 399/55; 399/56
(58) Field of Search ..... 399/53, 55, 56, 399/148, 149, 150

(56) References Cited

U.S. PATENT DOCUMENTS 5,805,960 A * 9/1998 Suzuki et al. ..... 399/149
6,006,055 A * 12/1999 Furuya ..... 399/149
6,052,545 A * 4/2000 Komiya et al. ..... 399/61

* cited by examiner

*Primary Examiner*—Hoang Ngo
(74) *Attorney, Agent, or Firm*—Fitzpatrick, Cella, Harper & Scinto

(57) ABSTRACT

An image forming apparatus having an image carrier, a charging unit for charging the image carrier and residual toner on the image carrier, a charging bias applying unit, an electrostatic image forming unit, a developing unit for collecting the residual toner on the image carrier and visualizing the electrostatic image, and a developing bias regulating unit. The apparatus further comprises an image ratio calculating unit for calculating an image ratio on the basis of the electrostatic image, and a regulating unit for regulating a contrast potential between the developing unit collecting the residual toner and the image carrier on the basis of a calculated image ratio. In the apparatus, an occurrence of the problem of adhesion of toner to a non-image area is prevented by fully collecting transfer residual toner also in forming an image having a high image ratio.

4 Claims, 4 Drawing Sheets

IMAGE FORMING APPARATUS USING IMAGE CARRIER CLEANERLESS SYSTEM

BACKGROUND OF THE INVENTION

1. Field of the Invention

The present invention relates to an image forming apparatus such as a copying machine using an electrophotographic system or an electrostatic recording system, and particularly to what we call a cleanerless system that collects residual toner on an image carrier into a developing device for reuse.

2. Description of the Related Art

In recent years, image forming apparatuses such as copying machines have been progressively downsized. There has been, however, a limit to only downsizing units for carrying out charging, exposing, developing, transferring, fixing, and cleaning processes. In addition, in an image forming apparatus using a system to transfer a toner image formed on an image carrier to a recording material, a cleaner collects residual toner on the image carrier and disposes of it as waste. It is not environmentally preferable, however.

Therefore, there has been suggested what we call a cleanerless system that collects residual toner on an image carrier into a developing unit for reuse. This system collects the residual toner on the image carrier into the developing unit in a process of visualizing an electrostatic image on the image carrier by means of the developing unit to reuse the collected toner for forming another image. In the process of visualizing the electrostatic image on the image carrier by means of the developing unit, the developing unit is provided with a developing bias including an alternation of a voltage generating an electric field in a direction where the toner moves from the developing unit to the image carrier (hereinafter, referred to as development accelerating voltage) and a voltage generating an electric field in a direction where the toner returns from the image carrier to the developing unit (hereinafter, referred to as a collecting voltage). The residual toner on the image carrier is collected to the developing unit by means of a potential difference (hereinafter, referred to as a V-back potential difference) between the collecting voltage of the developing bias applied to a developing sleeve of the developing unit, which is a developer carrier, and a potential of an image carrier surface charged by a charger.

As a method of charging the image carrier, a contact-type charging unit has been gradually put to practical use since advantages of low ozone and low power are achieved: in the contact-type charging unit, a charging member (contact charging member) having a voltage (charging bias) is contacted against a photosensitive member as to charge a surface of the photosensitive member at predetermined potential and polarity. Particularly, a roller charging type charging unit using a charging roller (conductive roller) as a charging member is preferable in stability of charging and it is in popular use.

When forming an image having a high image ratio (a ratio of the number of dots of an image formed on the image carrier to the highest number of dots that can be formed in an image area on a recording material) thereof, however, the image formation requires a large amount of toner and it inevitably leads to a large amount of transfer residual toner every time an image is formed. In this condition, a part of the transfer residual toner is not collected to the developing device, thus causing a problem that the toner adheres to a non-image area.

SUMMARY OF THE INVENTION

Therefore it is an object of the present invention to prevent an occurrence of the problem of adhesion of toner to a non-image area by fully collecting transfer residual toner also in forming an image having a high image ratio in an image forming apparatus using a cleanerless system.

It is another object of the present invention to provide an image forming apparatus, comprising: an image carrier; a charging unit for charging the image carrier and residual toner on the image carrier; charging bias regulating unit for regulating a charging bias applied to the charging unit; an electrostatic image forming unit for forming an electrostatic image on the image carrier charged by the charging unit; a developing unit, to which there is applied a developing bias made of an alternating voltage between a development accelerating voltage and a collecting voltage, for collecting the residual toner on the image carrier and visualizing the electrostatic image; a developing bias regulating unit for regulating the developing bias applied to the developing unit; and an image ratio calculating unit for calculating an image ratio on the basis of the electrostatic image formed on the image carrier, wherein an increase of the image ratio increases a potential difference between a potential of the image carrier charged by the charging unit and a potential of the collecting voltage of the developing bias.

DETAILED DESCRIPTION OF THE PREFERRED EMBODIMENTS

[General Configuration of Image Forming Apparatus]

Figure 1:
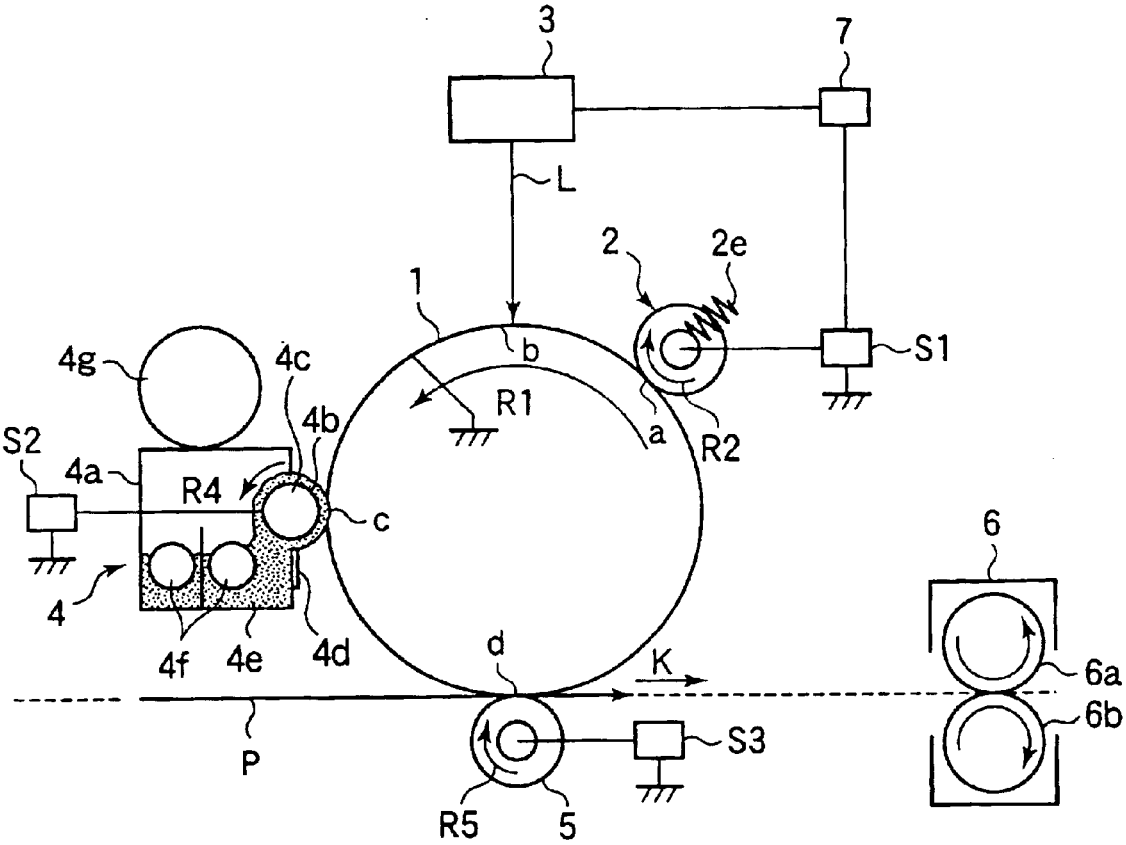
FIG. 1 is a diagram typically showing a configuration of an image forming apparatus according to an embodiment of the present invention.

An image forming apparatus according to this embodiment has a photosensitive drum (image carrier) 1 as shown in FIG. 1. Around the photosensitive drum 1, the following units are disposed almost in order in its rotating direction (the direction indicated by an arrow R1): a charging roller 2 (a contact charging member) as a charging unit for charging a surface of the image carrier, an exposing apparatus (an exposing unit) 3 for forming an electrostatic latent image on the image carrier on the basis of image information, a developing apparatus (a developing unit) 4 for carrying on a developing sleeve developer that is a mixture of toner and magnetic carriers, collecting residual toner on the image carrier, and forming a toner image by visualizing an electrostatic image on the image carrier, an a transfer roller (a transferring unit) 5 for transferring the toner image on the image carrier to a transferring material. In addition, a fixing apparatus (a fixing unit) 6 is disposed on the downstream side of the transfer roller 5 in a recording material P conveying direction (the direction indicated by an arrow K). Furthermore, there is provided a regulating unit 7 for regulating a charging bias DC component voltage applied to the charging roller 2 and an output of a light emitting element of the exposing unit 3 by calculating an image ratio from the electrostatic image formed on the photosensitive drum 1 that is the image carrier, on the basis of image information.

Image data sent from an image reader (not shown) or the like is stored once in a memory. Thereafter, the regulating unit 7 calculates an image ratio from an electrostatic image formed on the photosensitive drum 1 that is the image carrier, on the basis of the stored image data. In this connection, the image ratio can be expressed as follows:

Image ratio=(Number of picture elements formed on image carrier)/(Maximum number of picture elements that can be formed on recording material for printing)

Figure 3:
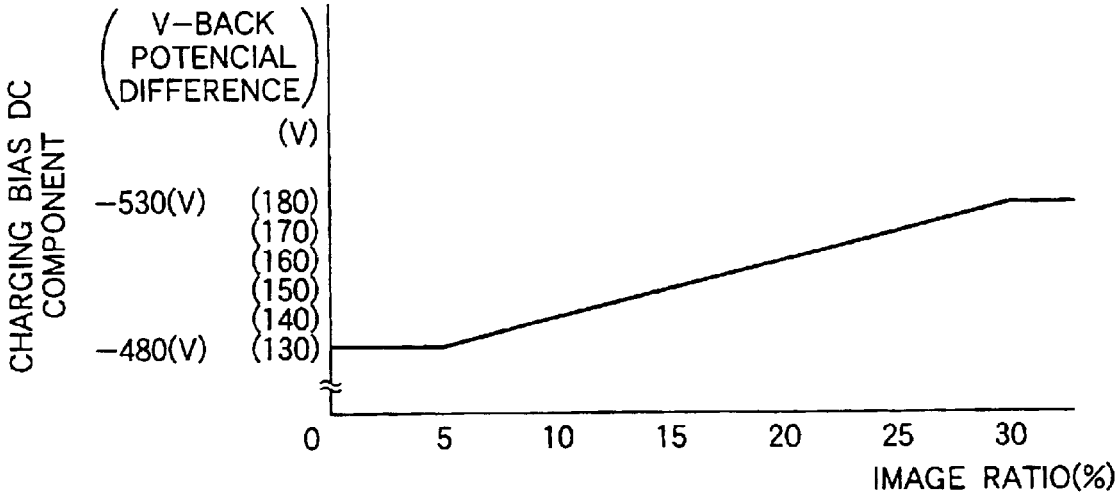
FIG. 3 is a diagram showing a voltage value of a DC component of a bias applied to the charging member and a V-back potential difference to an image ratio according to the embodiment of the present invention.

The regulating unit 7 regulates a charging bias DC component voltage applied to the charging roller according to the calculated image ratio. A concrete description of the regulation is shown in FIG. 3. In FIG. 3, the abscissa axis represents an image ratio and the ordinate axis represents a DC component voltage of the voltage applied to the charging roller, where values in parentheses on the ordinate axis represent V-back potential differences. In this embodiment, the developing bias DC component is assumed −350V. As shown in FIG. 3, the DC voltage of the bias applied to the charging member 2 is adjusted, so that the V-back potential difference increases along with an increase of the image ratio. More specifically, the DC component of the bias applied to the charging member 2 is adjusted in such a way as to increase toward the charged polarity along with an increase of the image ratio. For example, when reading an original having an image ratio of 15% by means of an image reader and copying the original, the regulating unit 7 regulates an output of a power supply S1 to −500V so as to cause the V-back potential difference to be 150V.

An increase of the image ratio increases an amount of toner necessary for forming a toner image on the image carrier and it inevitably leads to an increase of transfer residual toner. Immediately after the transfer, positive and negative polarities are mixed in the transfer residual toner. The charging member 2, however, makes uniform the polarities to a normal polarity (negative polarity in this embodiment). The transfer residual toner made uniform to the negative polarity moves to the developing sleeve due to a potential difference between a potential of the charged image carrier surface and a potential of the developing sleeve so as to be collected. The movement of the transfer residual toner from the image carrier to the developing device is a movement of particles having electric charges and therefore it can be seen as a current flow. In this connection, even if a large amount of transfer residual toner remains due to an increase of the image ratio, toner collection is enabled by increasing the potential difference between the image carrier and the developing sleeve (V-back potential difference) so that much current flows.

If the V-back potential difference increases, the magnetic carriers carried by the developing sleeve move to the image carrier by a very small amount and adhere to the image carrier. While the adhesion of the magnetic carriers has no effect on the image, it causes a lack of magnetic carriers in the developing device in the long term, by which magnetic carriers need be supplied to the developing device. Therefore, the V-back potential difference is changed according to the image ratio.

In addition, if a potential of the charged image carrier changes, the potential after an exposure with the exposing unit 3 changes, too. In other words, a change of the voltage applied to the power supply S1 changes a density of the image. Therefore, in this embodiment, the regulating unit 7 also regulates an output of the light emitting element of the exposing unit 3 to suppress the density variation, together with regulating the voltage applied to the charging unit 2.

The following describes details of the members as components of the image forming apparatus according to the embodiment.

(1) Photosensitive Drum (Image Carrier)

The image forming apparatus according to the first embodiment has the photosensitive drum 1 (rotating drum type electrophotographic photosensitive member) as an image carrier. The photosensitive drum 1 has a photosensitive layer formed by an organic photo conductor (OPC) (or organic optical semiconductor) having negative charging polarity. The photosensitive drum 1 is 50 mm in diameter and is rotationally driven in the direction indicated by the arrow R1 around a central shaft (not shown) at a process speed (circumferential speed) of 100 mm/sec.

Figure 2:
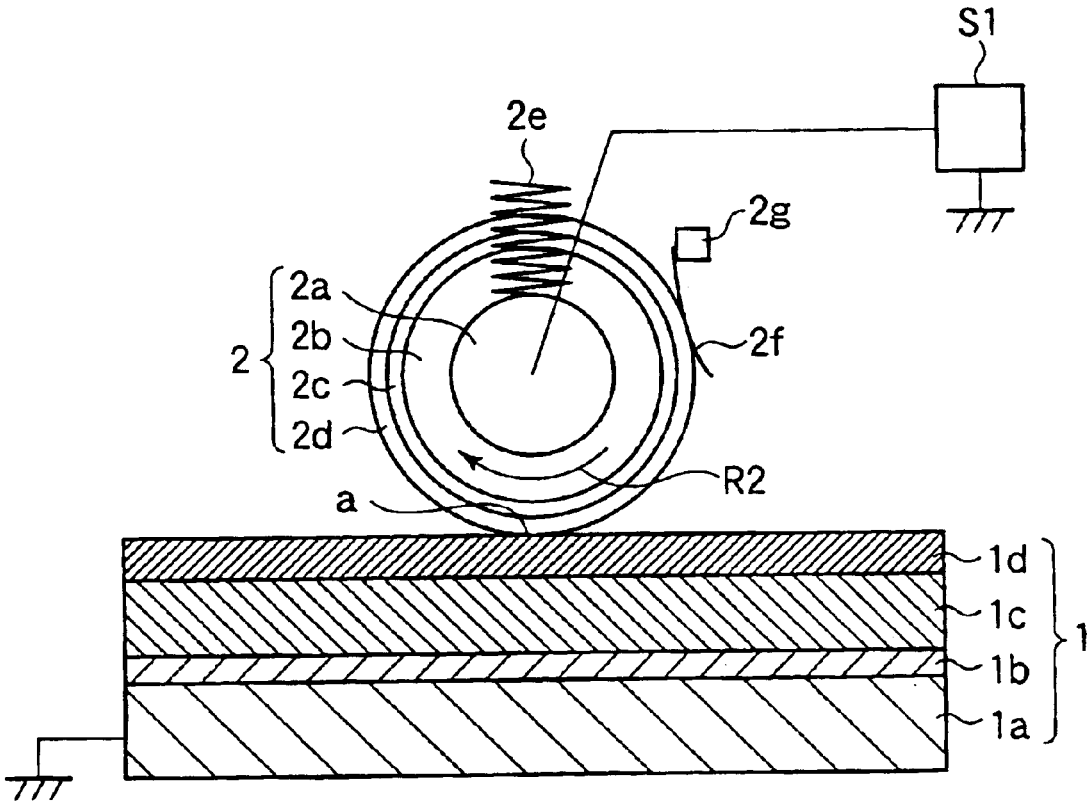
FIG. 2 is a diagram typically showing a configuration of an image forming apparatus according to another embodiment of the present invention.

Referring to FIG. 2, there is typically shown a layer structure of the photosensitive drum 1. As shown in FIG. 2, the photosensitive drum 1 has a conductive drum substrate (a conductive substrate: for example, an aluminum cylinder) 1*a* in the inner side (the lower side of the drawing). Its surface is coated with three layers, namely, an undercoating layer 1*b* preventing light interference and improving adhesion properties of an overlying layer, a charge generation layer 1*c*, and a charge transport layer 1*d* in order from within the photosensitive drum. Among them the charge generation layer 1*c* and the charge transport layer 1*d* form the photosensitive layer. The conductive drum substrate 1*a* is grounded.

(2) Charging Roller (Contact Charging Member)

As shown in the pattern diagram in FIG. 2, the charging roller 2 as the charging unit is rotatably supported by a bearing member (not shown) at both ends of a core metal 2*a*. The bearing member is urged toward the photosensitive drum 1 by means of a pushing spring (compression spring) 2*e* as an urging member. Thereby, the charging roller 2 is contacted with a given contact pressure against the surface of the photosensitive drum 1, thus forming a charging portion (a charging nip portion) a between the charging roller 2 and the surface of the photosensitive drum 1. The charging roller 2 rotates in a direction indicated by an arrow R2 following the rotation of the photosensitive drum 1 in the direction indicated by the arrow R1.

To the charging roller 2, the charging bias applying power supply S1 applies a charging bias. The charging bias applying power supply S1 applies an oscillating voltage generated by superimposing the alternating voltage on the DC voltage as the charging bias to the core metal 2*a* of the charging roller 2. The applied DC voltage is changed according to the image ratio within a range of −350V to −530V. At this point, a surface of the image carrier is also charged to around −350V to −530V due to an action of the alternating voltage at the same time. The alternating voltage is assumed constant independently of the change of the DC voltage.

This causes the surface of the rotating photosensitive drum 1 to be charged equally (uniformly) at a given polarity and potential. The charging bias applying power supply S1 detects a discharge current amount between the charging roller 2 and the photosensitive drum 1 and is variably controlled by a discharge current amount controlling unit (not shown) for controlling the discharge current on the basis of the detected amount so as to carry out charging with a minimum current amount.

The charging bias applied to the charging roller 2 by the charging bias applying power supply S1 is regulated by the regulating unit 7 (See FIG. 1). The alternating voltage in the above means all voltages whose amplitudes vary with the time, such as a sine wave, a square wave or a triangular wave.

The charging roller 2 is 320 mm in length (length in an axial direction). As shown in the layer structure pattern diagram of FIG. 2, the charging roller 2 has a 3-layer structure made of a underlying layer 2*b*, a middle layer 2*c*, and a surface layer 2*d* sequentially laid from the inside on an outer peripheral surface of the core metal (supporting member) 2*a*. The underlying layer 2*b* is an expanded sponge layer for reducing a charging noise. The surface layer 2*d* is a protective layer to prevent a leakage even if a pinhole or any other defect may exist on the photosensitive drum 1.

More specifically, the specifications of the charging roller 2 according to this embodiment are as follows.

Core metal 2*a*: Stainless round steel (6 mm in diameter)

Underlying layer 2*b*: Carbon-dispersed foamed EPDM (0.5 g/cm$^3$ in specific gravity, $10^2$ to $10^9$ Ω·cm in volume resistivity, 3.0 mm in layer thickness, 320 mm in length)

Middle layer 2*c*: Carbon-dispersed NBR rubber ($10^2$ to $10^9$ Ω·cm in volume resistivity, 700 μm in layer thickness)

Surface layer 2*d*: TORESIN resin as fluorine compound with tin oxide and carbon dispersed ($10^7$ to $10^{10}$ Ω·cm in volume resistivity, 1.5 μm in surface roughness (JIS standard: Ten point average surface roughness Ra), 10 μm in layer thickness).

As shown in FIG. 2, the charging roller 2 is provided with a charging roller cleaning member 2*f*. The charging roller cleaning member 2*f* is a cleaning film having flexibility in this embodiment. The charging roller cleaning member 2*f* is disposed in parallel with a long side of the charging roller 2 and disposed with one end (the upper end in FIG. 2) fixed to a supporting member 2*g* reciprocating by a given amount in the longitudinal direction and with the other free end (the lower end in the diagram) forming a contact nip with the charging roller 2 in the surface area near the free end. The supporting member 2*g* is driven in such a way as to reciprocate by a given amount in a longitudinal direction via a layout of gears (not shown) by a driving motor (not shown) of the image forming apparatus. This causes the charging roller cleaning member 2*f* to rub the surface layer 2*d* of the charging roller 2. The rubbing and the rotation of the charging roller 2 in the direction indicated by the arrow R2 remove adhering contamination (powdered toner, additive, etc.) adhering to the surface layer 2*d* of the charging roller 2.

(3) Exposing Apparatus (Information Writing Unit)

The image forming apparatus in FIG. 1 has the exposing apparatus 3 as means for writing information for forming an electrostatic image on the surface of the charged photosensitive drum 1. The exposing apparatus 3 is a laser beam scanner using a semiconductor laser in this embodiment. The exposing apparatus 3 outputs a laser beam L modulated so as to correspond to an image signal sent from a host processor such as an image reader (not shown) to the image forming apparatus. The laser beam L carries out a scanning exposure (image exposure) in an exposure position b on the surface of the charged and rotating photosensitive drum 1. The scanning exposure lowers the potential of the irradiated portion with the laser beam L on the charged area of the surface of the photosensitive drum 1, thereby forming the electrostatic image corresponding to the image information. The output of the exposing apparatus 3 is regulated by the regulating unit 7 according to the potential of the charging bias applied to the charging member 2. The regulation helps the potential of the image area, which is an exposed area, to remain constantly at approx. −100V independently of the charging bias voltage. In this embodiment, as an example, the output for a case where −530V is applied to the charging member 2 is set to be approx. 10% larger than that for a case where −480V is applied to the charging member.

(4) Developing Apparatus (Developing Unit)

The developing apparatus (developing device) 4 as means for development supplies developer (toner) to the electrostatic image on the photosensitive drum 1 so as to visualize the electrostatic latent image as a toner image. In this embodiment, the developing apparatus 4 is a reversal developing apparatus of two-component magnetic brush developing type.

The developing apparatus 4 comprises a developing container 4*a*, a developing sleeve 4*b*, a magnetic roller 4*c*, a developer coating blade 4*d*, a developer agitating member 4*f*, and a toner hopper 4*g*. A reference numeral 4*e* in FIG. 1 designates two-component developer contained in the developing container 4*a*.

The developing container 4*a* contains the two-component developer 4*e* and rotatably supports the developing sleeve 4*b* or the like. The developing sleeve 4*b* is a nonmagnetic cylindrical member and is rotatably disposed in the developing container 4*a* with a part of the outer peripheral surface exposed outside. The magnet roller 4*c* is provided in an inserted condition inside the developing sleeve 4*b* in a non-rotatably fixed condition. The developer coating blade 4*d* regulates a layer thickness of the two-component developer 4*e* with which the surface of the developing sleeve is coated. The developer agitating member 4*f* is disposed at the bottom of the developing container 4*a* inside thereof to agitate the two-component developer 4*e* and to convey it to the developing sleeve 4*b*. The toner hopper 4*g* is a container storing supplemental toner for a supplement to the developing container 4*a*.

The two-component developer 4*e* in the developing container 4*a* is a mixture of toner and magnetic carriers and is agitated using the developer agitating member 4*f*. In this embodiment, a resistance of the magnetic carriers is approx. $10^{13}$ Ω·cm and a particle diameter thereof is 40 μm. The toner is friction-charged to a negative polarity by rubbing friction between the toner and the magnetic carriers.

The above developing sleeve 4*b* is disposed oppositely to the photosensitive drum 1 in the condition where the shortest distance (S-D gap) from the photosensitive drum 1 is kept to 350 μm so as to be close to the photosensitive drum 1. The opposed portion between the photosensitive drum 1 and the developing sleeve 4*b* is a developing portion c. The developing sleeve 4*b* is rotationally driven in a direction where its surface moves in a direction opposite to the surface moving direction of the photosensitive drum 1 in the developing portion c. More specifically, it is rotationally driven in a direction indicated by an arrow R4, contrary to the rotation in the direction indicated by the arrow R1 of the photosensitive drum 1.

A part of the two-component developer 4*e* in the developing container 4*a* is absorbed (or adhered) and maintained as a magnetic brush layer on the outer peripheral surface of the developing sleeve 4*b* by means of a magnetic force of the inner magnetic roller 4*c* and it is conveyed rotationally with the rotation of the developing sleeve 4*b*.

The magnetic brush layer is aligned into a given thin layer by the developer coating blade 4*d* and is contacted on the surface of the photosensitive drum 1 in the developing portion c, thereby moderately rubbing against the surface of the photosensitive drum 1. The contact of the magnetic brush on the photosensitive drum 1 as the image carrier causes an effect of scraping the transfer residual toner from the photosensitive drum 1, thereby improving the efficiency of collecting the transfer residual toner. In addition, the opposite rotating direction between the photosensitive drum 1 and the developing sleeve further enhances the scraping effect, by which the transfer residual toner can be collected more efficiently. A developing bias applying power supply S2 applies a given developing bias to the developing sleeve 4*b*. In this embodiment, the developing bias applied to the developing sleeve 4*b* is an alternating voltage with a development accelerating voltage of −1150 V and a collecting voltage of +450 V.

In the above developing apparatus 4, the developer in the developing container 4*a* is used for a thin coating on the surface of the rotating developing sleeve 4*b* and is conveyed to the developing portion c. In this portion, toner in the developer is selectively attached to the photosensitive drum 1 so as to correspond to an electrostatic image on the photosensitive drum 1 by means of an electric field caused by the developing bias applied to the developing sleeve 4*b* by the developing bias applying power supply S2. Thereby, the electrostatic image is developed as a toner image. In this embodiment, the toner is attached to an exposed light portion (laser beam irradiated portion) on the photosensitive drum 1, by which the electrostatic image is developed in reverse.

At this point, a charged amount of the toner developed on the photosensitive drum 1 is −25 $\mu$C/g.

The developer thin layer on the developing sleeve 4*b* having passed through the developing portion c is returned to a developer reservoir in the developing container 4*a* with the subsequent rotation of the developing sleeve 4*b*.

In order to maintain a toner density of the two-component developer 4*e* in the developing container 4*a* almost within a given range, the toner density of the two-component developer 4*e* in the developing container 4*a* is detected, for example, by an optical toner density sensor (not shown), the toner hopper 4*g* is driven and controlled according to the detection information, and the toner in the toner hopper is supplied to the two-component developer 4*e* in the developing container 4*a*. The toner supplied to the two-component developer 4*d* is agitated by means of the agitating member 4*f*.

(5) Transfer Roller (Transferring Unit) and Fixing Apparatus (Fixing Unit)

In this embodiment, the transfer roller 5 is used as means for transferring. The transfer roller 5 is contacted with a given pushing pressure against the surface of the photosensitive drum 1. Its contact pressure nip portion is a transfer portion d. A recording material P (for example, paper or a transparent film) is fed to the transfer portion d from a feeder (not shown) at a given control timing.

The recording material P fed to the transfer portion d is held tight between the photosensitive drum 1 rotating in the direction indicated by the arrow R1 and the transfer roller 5 rotating in a direction indicated by an arrow R5 and conveyed. During the time, a transfer bias applying power supply S3 applies a transfer bias of positive polarity (+2 kV in this embodiment), which is a reversed polarity to the negative polarity that is the normal charging polarity of the toner, to the transfer roller 5. Thereby, the toner image on the photosensitive drum 1 is electrostatically transferred sequentially to the surface of the recording material P.

The recording material P having been subjected to the toner image transfer by passing through the transfer portion d is sequentially separated from the surface of the photosensitive drum 1 and conveyed to the fixing apparatus 6, where it is heated and pressed by a fixing roller 6*a* and a pressure roller 6*b*, by which the toner image is fixed to the surface of the recording material P. Then, it is output as an image-formed object (a print or a copy).

(6) Regulating Unit

The regulating unit 7 calculates an image ratio from the electrostatic image formed on the photosensitive drum 1 which is the image carrier, on the basis of the image information sent from the document reader (not shown) or the like. Thereafter, it regulates a DC-component voltage of the bias applied to the charging roller 2 on the basis of the image ratio. In addition, it also regulates an output from the light emitting element of the exposing unit 3.

The image forming apparatus according to this embodiment is of the cleanerless process type. Therefore, it is not provided with a dedicated cleaner for removing toner remaining on the surface of the photosensitive drum 1 without being transferred to the recording material P in the transfer portion d (transfer residual toner). As described later, the transfer residual toner reaches the charging portion a by the subsequent rotation of the photosensitive drum 1 and temporarily adheres to the charging roller 2 in contact with the photosensitive drum 1. Then, the adhesion toner is discharged on to the photosensitive drum 1 again and finally is collected to the developing apparatus 4. Thus, the photosensitive drum 1 is submitted to the image formation repeatedly.

[Image-Formation Operating Process]

The following describes an operation sequence of the image forming apparatus having the above configuration.

(1) Pre-multiple rotation process: A starting operation period (an activating operation period or a warming period) of the image forming apparatus. A main motor of the image forming apparatus is driven by turning on the main power switch to cause the photosensitive drum 1 to be rotationally driven for carrying out a preparatory operation of predetermined process equipment.

(2) Pre-rotation process: A period for executing a pre-operation of the image formation. If an image formation signal is input during the pre-multiple rotation process, the pre-rotation process is executed subsequently to the pre-multiple rotation process. If no image formation signal is input, the driving of the main motor is halted once after an end of the pre-multiple rotation process so as to halt the rotational driving of the photosensitive drum 1 and the image forming apparatus is maintained in a standby condition until an image formation signal is input. When the image formation signal is input, the pre-rotation process is executed.

(3) Image formation process (Printing process): After an end of the predetermined pre-rotation process, subsequently there is executed an image formation process for the photosensitive drum 1. In this process, the regulating unit 7 regulates the DC-component voltage of the bias applied to the charging member 2 and the output from the light emitting element 3 of the exposing unit on the basis of the image ratio. The toner image formed on the surface of the photosensitive drum 1 is transferred to the recording material P and then the fixing apparatus 6 fixes the toner image. Thereafter, the image-formed object is output. In a continuous image formation (continuous printing) mode, the above image formation process is executed repeatedly by a predetermined number of sheets set for image formation.

(4) Inter-paper process: In the continuous image formation mode, a not-pass condition period of the recording material P in the transfer portion d between the time when the back end of a preceding recording material P passed the transfer portion d and the time when the front end of the next (subsequent) recording material P reaches the transfer portion d. During the time when an area on the surface of the photosensitive drum 1 that is to pass the transfer portion d during the inter-paper process passes the charging portion a previously, the application of the AC component of the charging bias is halted and the transfer residual toner temporarily adhering to the charging roller 2 is discharged on to the surface of the photosensitive drum 1.

(5) Post-rotation process: A period during which the driving of the main motor is continued for a while after the end of the image formation process of the last recording material P for the rotational driving of the photosensitive drum 1 and predetermined post-operation is executed. Also in this period, the application of the AC component of the charging bias is halted similarly to the inter-paper process so as-to discharge the transfer residual toner temporarily adhering to the charging roller 2 on to the surface of the photosensitive drum 1.

(6) Standby: The end of the predetermined post-rotation process causes the driving of the main motor to be stopped, the rotational driving of the photosensitive drum 1 to be stopped, and the image forming apparatus to be put in a standby state until the next image formation start signal is input.

If an image is formed on only one sheet of recording material, the image forming apparatus passes through the post-rotation process and is put in the standby state after the end of the image formation. If an image formation start signal is input in the standby state, the image forming apparatus shifts to the pre-rotation process.

The image formation process in the above (3) corresponds to an image formation state. The pre-multiple rotation process in (1), the pre-rotation process in (2), the inter-paper process in (4), and the post-rotation process (5) correspond to a non-image formation state.

[Cleanerless System]

Since the image forming apparatus according to this embodiment uses a cleanerless process, the toner remaining on the surface of the photosensitive drum 1 (transfer residual toner) is conveyed to the charging portion a of the photosensitive drum 1 after the toner image transfer to the recording material P and adheres to the charging roller 2 so as to be temporarily collected. In many cases, the transfer residual toner on the photosensitive drum 1 is a mixture of toner of positive polarity (inverted toner) and that of negative polarity due to the separating discharge at the transfer. The transfer residual toner of mixed polarities reaches the charging roller 2 and temporarily adheres to it. The adhesion of the transfer residual toner to the charging roller 2 is further increased by the application of the alternating voltage to the charging roller 2 due to an oscillating field effect between the charging roller 2 and the photosensitive drum 1. Particularly, the adhesion of the inverted toner is more remarkable than that of the toner of negative polarity. The toner of negative polarity in the transfer residual toner adhering to the charging roller 2 is discharged on to the photosensitive drum 1. The toner of positive polarity is normalized in polarity by means of a rubbing friction against the charging roller cleaning member 2*f* described above and is discharged on to the photosensitive drum 1.

The transfer residual toner of normal polarity discharged on to the photosensitive drum 1 reaches the developing portion c and is collected by cleaning simultaneous with developing by means of a fog removing electric field at developing through the developing sleeve 4*b* of the developing apparatus 4. The collection of the transfer residual toner simultaneous with developing is carried out simultaneously with other image formation processes such as charging, exposure, developing, and transfer if an image area in the rotating direction is longer than the perimeter of the photosensitive drum 1. This causes the transfer residual toner to be collected into the developing apparatus 4 and used for the subsequent processes, thereby eliminating waste toner. In addition, it is very advantageous in space, thus enabling remarkable downsizing of the image forming apparatus.

By using high release-characteristic spherical toner manufactured in the polymerization method as toner of the two-component developer 4*e* in the above, the transfer residual toner can be less generated, while improving the collection-characteristic of the toner discharged from the charging roller 2 to the developing apparatus 4. The use of the developing apparatus 4 of the two-component contact development type also improves the collection-characteristic of the toner discharged from the charging roller 2 to the developing apparatus 4.

If a large amount of transfer residual toner is generated at a time, for example, in a continuous printing operation of an image having a high printing ratio such as a photographic image, however, the collection-characteristic decreases in the cleaning simultaneous with developing as described above, thus leading to a cause of a poor image such as a fog in a non-image area or poor charging caused by an adhesion to the charging roller 2 due to transfer residual toner brought along on the photosensitive drum 1 without being collected.

Regarding the charging bias setting for the charging roller 2, if an increase of the V-back potential difference is larger than necessary, the magnetic carrier adhesion occurs, and if the V-back potential difference is small, an improvement of the efficiency of collection cannot be expected as described above.

Referring to FIG. 3, there is shown an explanatory diagram illustrating a result of calculating the image ratio in this embodiment and setting values of the fog removing bias regulated according to the result. The abscissa axis represents an image ratio (%) and the ordinate axis represents a charging bias DC component voltage, where values in parentheses represent respective V-back potential differences.

Therefore, in this embodiment, the regulating unit 7 regulates the charging bias and regulates a surface potential of the charged photosensitive drum 1 according to the result of the image ratio calculation of the regulating unit 7 in the image formation. Varying the V-back potential difference by regulating the charging bias eliminates the necessity of regulating the developing bias.

Figure 4:
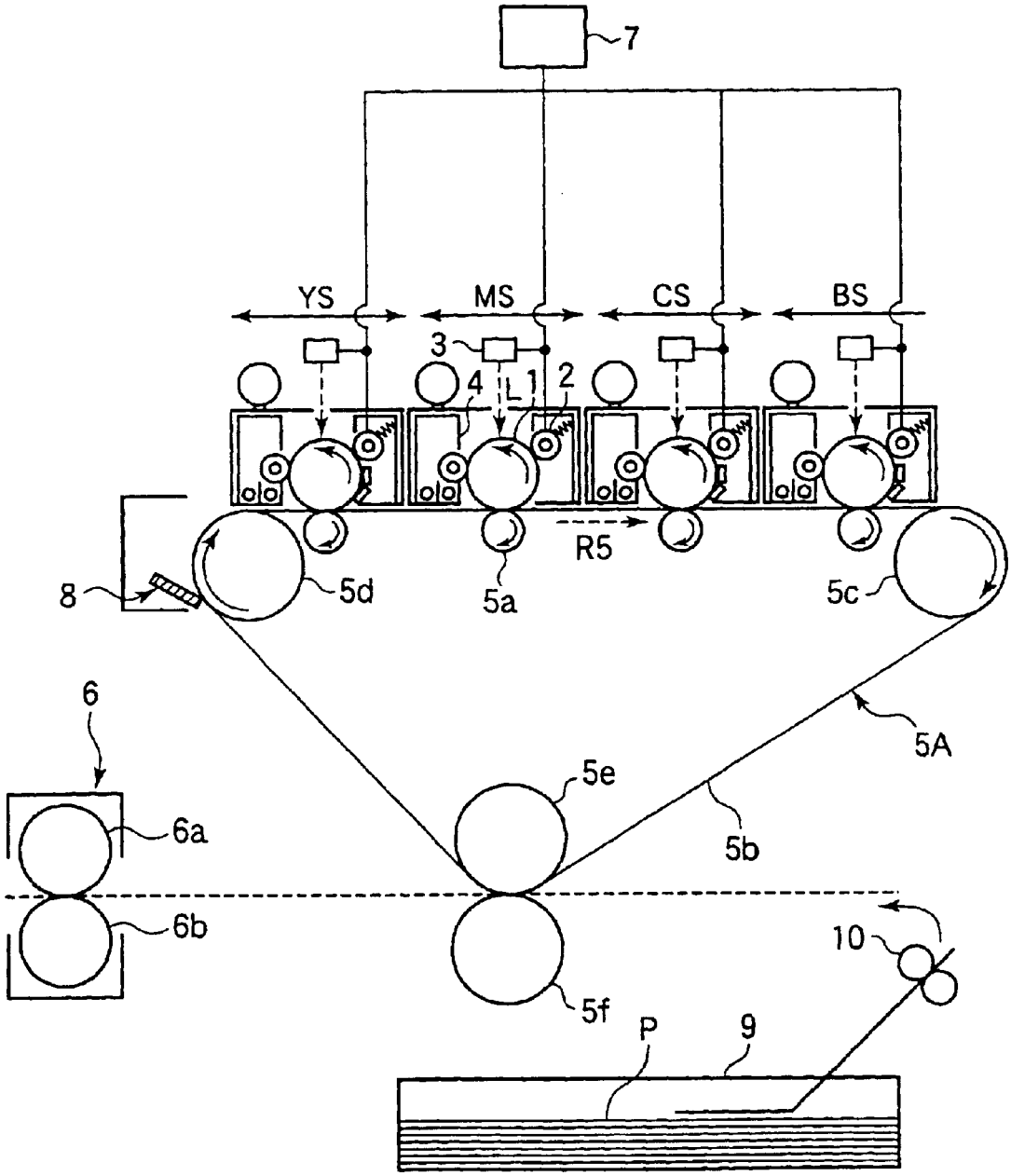
FIG. 4 is a cross section typically showing a layer structure of an image carrier and a charging unit.

Referring to FIG. 4, there is shown an image forming apparatus according to another embodiment. The image forming apparatus shown in this diagram is a four-color full-color type image forming apparatus, comprising a four image forming stations (image forming units) as means for forming an image and an intermediate transfer belt as an intermediate transfer member. The diagram is a longitudinal section typically showing a configuration in outline.

The image forming apparatus (printer) shown in FIG. 4 is provided with four image forming stations YS, MS, CS and BS each having almost the same structure. They form images (toner images) of yellow, magenta, cyan, and black in this order. Each image forming station has almost the same structure as for the image forming portion of the image forming apparatus shown in FIG. 1. More specifically describing by taking the image forming station MS for magenta as an example, the image forming station has a photosensitive drum (image carrier) 1, and further has a charging roller 2 (contact charging member), an exposing apparatus (exposing unit) 3, and a developing apparatus (developing unit) 4 along the photosensitive drum rotating direction (in a direction indicated by an arrow) almost in this order.

A transfer unit 5A is of an intermediate transfer type in this embodiment. The transfer unit 5A comprises primary transfer rollers 5*a* arranged for the respective image forming stations, an intermediate transfer belt (intermediate transfer member) 5*b* suspended around three rollers (a driving roller 5*c*, a tension roller 5*d*, and a secondary transfer opposite roller 5*e*), and a secondary transfer roller 5*f*.

Among them, the intermediate transfer belt 5*b* is made of polyethylene terephthalate, polyimide, or other synthetic resin with carbon dispersed for a resistance regulation. The intermediate transfer belt 5*b* is driven and rotated in a direction indicated by an arrow R5 with a clockwise rotation of the driving roller 5*c* in FIG. 4. The rotating direction of the intermediate transfer belt 5*b* is the same as a moving direction of a surface of the photosensitive drum in the primary transfer portion (a primary transfer nip portion), which is a contact portion between each photosensitive drum 1 and the intermediate transfer belt 5*b*. The tension roller 5*d* is adjusting the intermediate transfer belt 5*b* so as to maintain a given tension of the intermediate transfer belt 5*b* between the driving roller 5*c* and the secondary transfer opposite roller 5*e*. Each primary transfer roller 5*a* is disposed oppositely to each corresponding photosensitive drum 1 with the intermediate transfer belt 5*b* put between them, pushing the intermediate transfer belt 5*b* against the photosensitive drum 1. The secondary transfer roller 5*f* secondarily transfers four-color toner images superimposed on the intermediate transfer belt 5*b* to a recording material P at a time when a secondary transfer bias applying power supply (not shown) applies a secondary transfer bias to the secondary transfer roller 5*f*. A reference numeral 8 in FIG. 4 designates an intermediate transfer belt cleaner. The intermediate transfer belt cleaner 8 removes secondary transfer residual toner or paper powder adhering to the surface of the intermediate transfer belt 5*b* for cleaning the intermediate transfer belt 5*b*.

In the image forming apparatus of the intermediate transfer type as shown in FIG. 4, toner images of the respective colors, yellow) magenta, cyan, and black formed on the photosensitive drums 1 by the image forming stations YS, MS, CS, and BS are primarily transferred in this order sequentially to the intermediate transfer belt 5*b*, where the toner images of four colors are superimposed. On the other hand, the recording material P fed from a paper feed cassette 9 is supplied to a secondary transfer portion (a secondary transfer nip portion) between the intermediate transfer belt 5*b* and the secondary transfer roller 5*f* by means of a conveying roller 10, a registration roller (not shown), and the like. At this point, the secondary transfer bias applying power supply (not shown) applies a secondary transfer bias to the secondary transfer roller 5*f*. This causes the four-color toner images on the intermediate transfer belt 5*b* to be secondarily transferred to the recording material P at a time.

The recording material P after the toner image transfer is conveyed to a fixing apparatus 6, where it is heated and pressed by a fixing roller 6*a* and a pressure roller 6*b*, by which the toner image is fixed to the surface of the recording material P.

In this embodiment, the regulating unit 7 described in the first embodiment in the above is provided for each color. It varies the charging bias applied to each charging roller 2 (for each color) according to a result of calculating an image ratio of the color independently of other colors for each. This prevents an occurrence of the problem of adhesion of toner to a non-image area even if there is a deviation of the image ratio depending upon the color in color images of four colors. In addition, there is no need to supply the developing device with carriers.

In the first and second embodiments, the charging method with the charging roller has been described by using the number of picture elements of the image to be printed as means for calculating the image ratio in the image formation. It is also possible, however, to use various contact charging methods such as brush charging as other means for charging and to use a cumulative calculated value of a laser irradiation time for image exposure to the photosensitive drum 1, in other words, a cumulative calculated value of the time during which the laser irradiation to the photosensitive drum 1 at the image exposure is carried out simultaneously with the rotation of the photosensitive drum 1, as means for calculating the image ratio. In other words, an arbitrary detecting method can be used if the image ratio in the image formation is appropriately detected.

What is claimed is:

1. An image forming apparatus, comprising:

an image carrier;

charging means for charging said image carrier and toner on said image carrier;

electrostatic image forming means for forming an electrostatic image on said image carrier charged by said charging means;

developing means for electrostatically collecting the toner on said image carrier and for electrostaticallly developing the electrostatic image by using the toner to form a toner image;

bias applying means for applying a bias to said developing means;

transfer means for transferring the toner image on said image carrier onto a transfer medium; and control means for executing variable-control of a potential difference between a potential of said image carrier charged by said charging means and the bias applied to said developing means, based on a ratio at which the toner image occupies an area relative to a predetermined area on said image carrier.

2. An apparatus according to claim 1, wherein said control means controls the potential difference to be larger as the ratio is larger.

3. An apparatus according to claim 2, further comprising a power source for supplying a bias to said charging means, wherein said control means executes variable-control of the bias applied to said charging means, according to the ratio.

4. An apparatus according to claim 3, wherein the bias supplied to said charging means from said power source is a voltage obtained by superposing an AC voltage onto a DC voltage, and said control means controls the DC voltage according to the ratio.

* * * * *

UNITED STATES PATENT AND TRADEMARK OFFICE

CERTIFICATE OF CORRECTION

PATENT NO. : 6,941,095 B2
DATED : September 6, 2005
INVENTOR(S) : Hiroyuki Kidaka It is certified that error appears in the above-identified patent and that said Letters Patent is hereby corrected as shown below:

Drawings,
Sheet 3, “POTENCIAL” should read -- POTENTIAL --.

Column 2,
Line 59, “an” should read -- and --.

Column 5,
Line 14, “follows.” should read -- follows: --.

Column 9,
Line 18, “as-to” should read -- as to --.

Column 11,
Line 44, “yellow)” should read -- yellow, --.

Column 12,
Line 36, “electrostaticallly” should read -- electrostatically --.

Signed and Sealed this

Twenty-fourth Day of January, 2006

JON W. DUDAS
*Director of the United States Patent and Trademark Office*